US008405698B2

(12) United States Patent
Imai

(10) Patent No.: US 8,405,698 B2
(45) Date of Patent: Mar. 26, 2013

(54) PRINTER AND PRINTING METHOD

(75) Inventor: Ryo Imai, Saitama (JP)

(73) Assignee: Fujifilm Corporation, Tokyo (JP)

( * ) Notice: Subject to any disclaimer, the term of this patent is extended or adjusted under 35 U.S.C. 154(b) by 360 days.

(21) Appl. No.: 12/893,805

(22) Filed: Sep. 29, 2010

(65) Prior Publication Data

US 2011/0075175 A1 Mar. 31, 2011

(30) Foreign Application Priority Data

Sep. 30, 2009 (JP) ..... 2009-226581

(51) Int. Cl.
*B41J 11/00* (2006.01)

(52) U.S. Cl. ..... 347/218

(58) Field of Classification Search ..... 347/171, 347/172, 176, 187, 212, 215, 218, 110, 2; 358/296; 359/463; 400/582
See application file for complete search history.

(56) References Cited

U.S. PATENT DOCUMENTS

| | | | | |
|---|---|---|---|---|
| 5,764,266 | A * | 6/1998 | Azuma et al. | 347/171 |
| 5,812,152 | A | 9/1998 | Torigoe et al. | |
| 2009/0079770 | A1* | 3/2009 | Suzuki | 347/2 |
| 2010/0295915 | A1* | 11/2010 | Karszes et al. | 347/110 |
| 2011/0074906 | A1* | 3/2011 | Imai | 347/218 |

FOREIGN PATENT DOCUMENTS

| | | | |
|---|---|---|---|
| JP | 3471930 | B2 | 9/2003 |
| JP | 2007-76084 | A | 3/2007 |

* cited by examiner

*Primary Examiner* — Kristal Feggins
(74) *Attorney, Agent, or Firm* — McGinn IP Law Group, PLLC

(57) ABSTRACT

A clamper clamps an edge of a lenticular sheet and moves in a sub-scanning direction to transport the lenticular sheet. While the lenticular sheet is transported so as to form an image receptor layer on a rear side of the lenticular sheet, a sensor unit is moved in a main-scanning direction, such that the sensor unit is moved relative to the lenticular sheet in a direction which has a predetermined measurement scanning angle from the main-scanning direction. The sensor unit receives an inspection light projected toward and passed through the lenticular sheet, and outputs a detection signal corresponding to a received amount of the inspection light. Based on a variation of the inspection light, an oblique transportation angle of the lenticular sheet is calculated and the clamper is rotated in a direction to cancel the oblique transportation angle of the lenticular sheet.

18 Claims, 12 Drawing Sheets

PRINTER AND PRINTING METHOD

BACKGROUND OF THE INVENTION

1. Field of the Invention

The present invention relates to a printer and a printing method for recording an image on a lenticular sheet.

2. Description of the Related Arts

There is known a technique for observing a stereo image with use of a lenticular sheet, in which a plurality of lenticular lenses in the shape of a semicircular column are arranged in a lateral direction. For observing the stereo image, for example, one of whole images taken from two viewpoints in the lateral direction is sliced into linear images (stripes), and then the stripes are interlaced with stripes sliced from the other of the whole images. The stripes are printed on the rear side of the lenticular sheet, such that each of the stripes is printed on a corresponding lenticular lens. Accordingly, the stereo image can be observed, since a left eye sees one of the whole images and a right eye sees the other of the whole image having parallax with the former one. In addition, there is also known a technique for observing a stereo image with an enhanced stereoscopic effect by use of N ($N \geqq 3$) images from different viewpoints. In this technique, each of N whole images is sliced into stripes, and these stripes are aligned on the lenticular lenses in sequential order.

As a method for positioning the linear images on the rear side of the lenticular sheet, there is a method that a print (hard copy), in which all linear images are preliminarily arranged and printed, is attached on the rear side of the lenticular sheet. In addition, some printers utilize a method that the linear images are directly printed on the rear side of the lenticular sheet (for example, Japanese Laid-open Patent Publication No. 2007-76084).

In case that the image is directly recorded on the rear side of the lenticular sheet, a position of the image must be correctly adjusted on a position of the lenticular sheet. This requires recording the linear images accurately along the longitudinal direction of the lenticular lens.

To satisfy this requirement, the printer of Japanese Laid-open Patent Publication No. 2007-76084 has a recording head which discharges ink on a lenticular sheet on a carriage and an optical sensor. In the printer, when the carriage moves the lenticular sheet in a main-scanning direction for the purpose of recording an image, a position of the lenticular lens is detected by the optical sensor to control discharge timing of the ink by the recording head based on the detection result of the position of the lenticular lens. In addition, according to U.S. Pat. No. 5,812,152 (corresponding to Japanese Patent Laid-Open Publication No. 2007-76084), photointerrupters are disposed on both sides along the transportation direction of the lenticular sheet. The photointerrupters detect a position of the lenticular lens to find oblique transportation of the lenticular sheet. When the oblique transportation of the lenticular sheet is found, the oblique transportation is corrected by feeding the lenticular sheet with differential feeding amount between the both sides along the transportation direction.

However, in case that the discharge timing of the ink by the recording head is controlled based on the detection result of the position of the lenticular lens obtained from the optical sensor, as described in Japanese Laid-open Patent Publication No. 2007-76084, there is a problem that a deformation of the image recorded on the lenticular sheet becomes large when a degree of the oblique transportation of the lenticular sheet becomes high, thus resulting in deterioration of image quality. Further, in case that the oblique transportation of the lenticular sheet is corrected by feeding the lenticular sheet with differential feeding amount between the both sides along the transportation direction, as described in U.S. Pat. No. 5,812,152, the recorded image is not deformed normally. However, when at least one pitch of difference (oblique transportation) is caused between the photo interrupters on both sides along the transportation direction of the lenticular sheet, the oblique transportation cannot be appropriately corrected. Furthermore, in order to feed the lenticular sheet with differential feeding amount between the both sides along the transportation direction when the oblique transportation is occurred, two systems (left and right systems) of transportation mechanisms are needed, for example. The two systems are required to be precisely synchronized under normal conditions, such that feeding amount between the both sides along the transportation direction of the lenticular sheet becomes the same. The two systems are required to feed the lenticular sheet with differential feeding amount between the both sides along the transportation direction only when the oblique transportation is to be corrected. Accordingly, complicated controls and massive mechanisms are required to follow these two conditions.

SUMMARY OF THE INVENTION

An object of the present invention is to provide a printer and a printing method for correcting an oblique transportation of a lenticular sheet so that an image without a deformation can be recorded by a miniaturized mechanism with simple control.

In order to achieve the above and other objects, a printer of the present invention includes a clamper, a sheet transporter, a recorder, a rotation mechanism, and a rotation controller. The clamper clamps an edge of a lenticular sheet having a plurality of lenticular lenses. The sheet transporter moves the clamper in a sub-scanning direction to transport the lenticular sheet. The recorder records lines extended along a main-scanning direction sequentially on a rear side of the lenticular sheet in synchronization with transportation of the lenticular sheet by heating a rear side of an ink film putted on the rear side of the lenticular sheet with use of a thermal head such that ink is sublimated from the ink film and adhered on the rear side of the lenticular sheet. The lines constitute a linear image. The rotation mechanism rotates the clamper on a transportation surface of the lenticular sheet. The rotation controller optically detects an inclination of the lenticular lens in a longitudinal direction from the main-scanning direction or the sub-scanning direction while the lenticular lens is on the lenticular sheet clamped by the clamper, and controls the rotation mechanism based on the detection result such that the longitudinal direction of the lenticular lens becomes parallel to the main-scanning direction or the sub-scanning direction.

It is preferable that the printer further includes a sensor and a sensor transporter. The sensor includes a light projector for projecting inspection light toward the lenticular sheet and a light receiver for receiving the inspection light having passed through the lenticular sheet and outputting a detection signal corresponding to a received amount of the inspection light. The sensor transporter transports the sensor relative to the lenticular sheet. In this case, preferably, the rotation controller calculates an inclination angle of the lenticular lens in the longitudinal direction from the main-scanning direction or the sub-scanning direction based on the detection signal obtained from the sensor while the sensor is moved relative to the lenticular sheet, and controls the rotation mechanism such that the inclination angle is canceled through rotation of the clamper.

It is further preferable that the sensor transporter transports the sensor relative to the lenticular sheet in a direction which has a predetermined measurement scanning angle from the main-scanning direction. The measurement scanning angle is preferably no more than 45°.

It is also preferable that the sensor transporter transports the sensor relative to the lenticular sheet in the sub-scanning direction.

It is preferable that the sensor transporter transports the sensor in the main-scanning direction while transportation of the lenticular sheet is halted. It is preferable that the sensor transporter transports the sensor between the thermal head and the clamper.

It is preferable that the recorder foams a transparent image receptor layer, on which the ink is to be adhered, on the rear side of the lenticular sheet before recording an image including a plurality of the linear images with use of the ink film. It is preferable that the sheet transporter transports the lenticular sheet from upstream side to downstream side with respect to the thermal head to foam the image receptor layer, and then transports the lenticular sheet again from upstream side to downstream side with respect to the thermal head to record the image with use of the ink film. It is preferable that the sensor transporter transports the sensor relative to the lenticular sheet while the lenticular sheet is transported to form the image receptor layer.

It is preferable that the printer further includes a sensor, a sensor transporter, and a memory. The sensor includes a light projector for projecting inspection light toward the lenticular sheet and a light receiver for receiving the inspection light having passed through the lenticular sheet and outputting a detection signal corresponding to a received amount of the inspection light. The sensor transporter transports the sensor relative to the lenticular sheet. The memory memorizes a reference value obtained from a detection signal which is made while the sensor is transported by the sensor transporter relative to a test image. The test image has a plurality of stripes extended in the main-scanning direction and arranged in the sub-scanning direction at a predetermined pitch, and is recorded on a transparent recording sheet by the thermal head while the transparent recording sheet clamped by the clamper is transported by the sheet transporter. In this case, the rotation controller controls rotation of the clamper based on the reference value memorized in the memory and the detection signal obtained while the sensor is moved relative to the lenticular sheet.

A printing method of the present invention includes steps of optically detecting an inclination of a lenticular lens in a longitudinal direction from the main-scanning direction or the sub-scanning direction while the lenticular lens is on the lenticular sheet, and rotating a clamper, which clamps an edge of the lenticular sheet and transports the lenticular sheet in the sub-scanning direction, based on the detection result, such that the longitudinal direction of the lenticular lens becomes parallel to the main-scanning direction or the sub-scanning direction.

It is preferable that the detecting step includes obtaining a detection signal by transporting a sensor for projecting inspection light toward the lenticular sheet and receiving the inspection light having passed through the lenticular sheet relative to the lenticular sheet, and calculating an inclination angle of the lenticular lens in the longitudinal direction from the main-scanning direction or the sub-scanning direction based on the detection signal.

It is preferable that the sensor is transported relative to the lenticular sheet in a direction which has a predetermined measurement scanning angle from the main-scanning direction. The measurement scanning angle is preferably no more than 45°.

It is preferable that the sensor is transported relative to the lenticular sheet in the sub-scanning direction.

It is preferable that the sensor is transported in the main-scanning direction while transportation of the lenticular sheet is halted. It is preferable that the sensor is transported between the thermal head and the clamper.

It is preferable that the detection signal is obtained while the sensor is moved relative to the lenticular sheet which is transported from upstream side to downstream side with respect to the thermal head such that a transparent image receptor layer, on which the ink is to be adhered, is formed on the rear side of the lenticular sheet, before recording an image including a plurality of liner images each of which is constituted by lines with use of the ink film.

It is preferable that the detecting step includes obtaining a reference value from a detection signal which is made while the sensor is transported relative to a test image. The test image has a plurality of stripes extended in the main-scanning direction and arranged in the sub-scanning direction at a predetermined pitch, and is recorded on a transparent recording sheet by the thermal head while the transparent recording sheet clamped by the clamper is transported. The sensor projects inspection light toward the transparent recording sheet, receives the inspection light passed through the transparent recording sheet, and outputs the detection signal corresponding to a received amount of the inspection light. Rotation of the clamper is controlled based on the reference value and the detection signal obtained while the sensor is moved relative to the lenticular sheet.

According to the present invention, an inclination of the lenticular lens in the longitudinal direction from the main-scanning direction or the sub-scanning direction is optically detected while the lenticular lens is on the lenticular sheet, and the clamper, which clamps an edge of the lenticular sheet and transports the lenticular sheet in the sub-scanning direction, is rotated based on the detection result, such that the longitudinal direction of the lenticular lens becomes parallel to the main-scanning direction or the sub-scanning direction. Accordingly, an oblique transportation of the lenticular sheet can be corrected so that an image without a deformation can be recorded by a miniaturized mechanism with simple control.

Since the oblique transportation of the lenticular sheet is detected based on the detection signal obtained by transporting the sensor for projecting the inspection light toward the lenticular sheet and receiving the inspection light having passed through the lenticular sheet relative to the lenticular sheet, the oblique transportation of the lenticular sheet can be precisely detected and corrected regardless of how its degree is.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

[First Embodiment]

Figure 1:
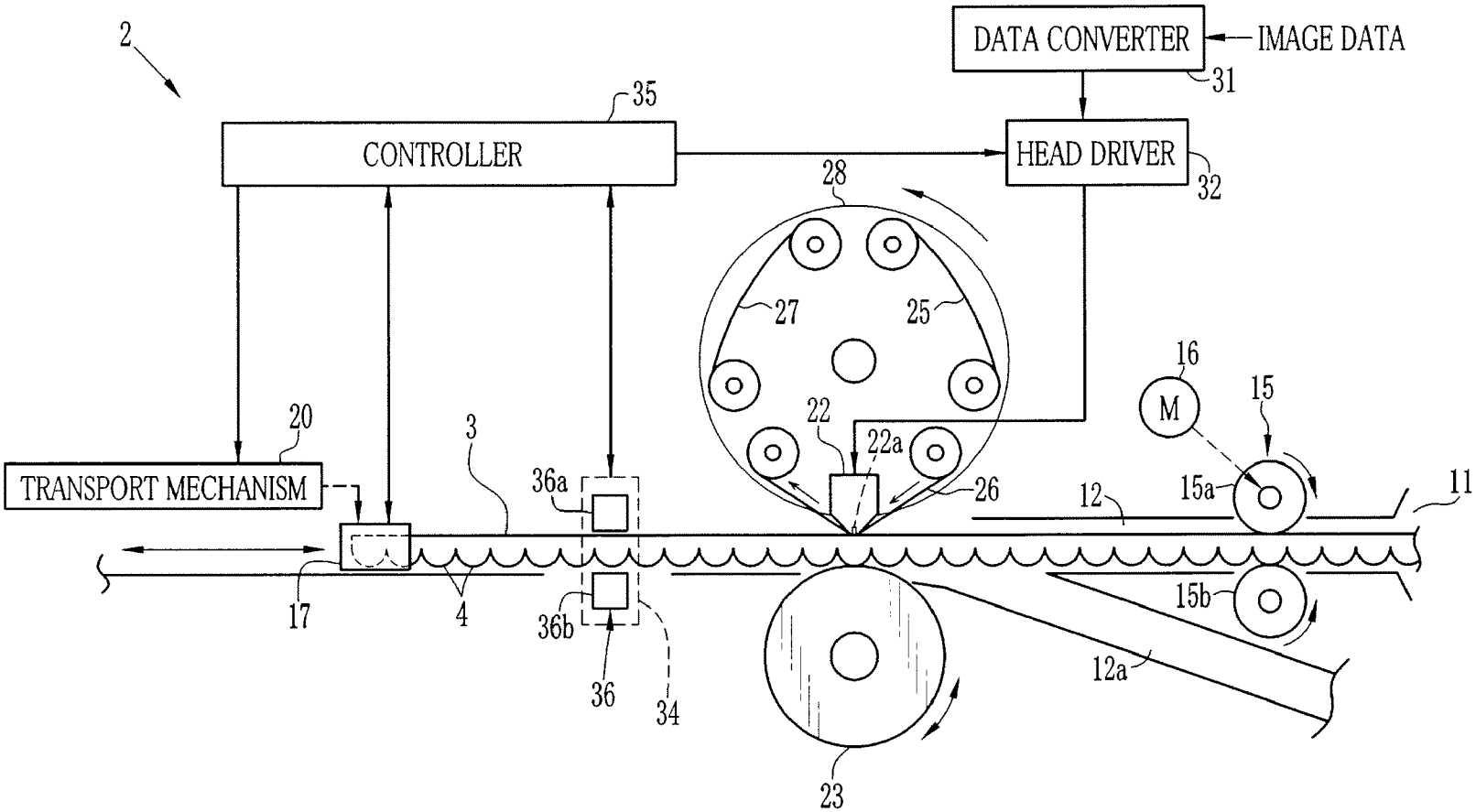
FIG. 1 is an explanatory drawing which illustrates an outline of a printer of the present invention.

FIG. 1 illustrates an outline of a printer of a first embodiment of the present invention. A printer 2 records parallax images on the rear side of a lenticular sheet 3 with use of a sublimation method, for observing a stereo image. The printer 2 converts parallax images of two viewpoints into parallax images of six viewpoints, and records the parallax images of six viewpoints on the lenticular sheet 3.

Figure 2:
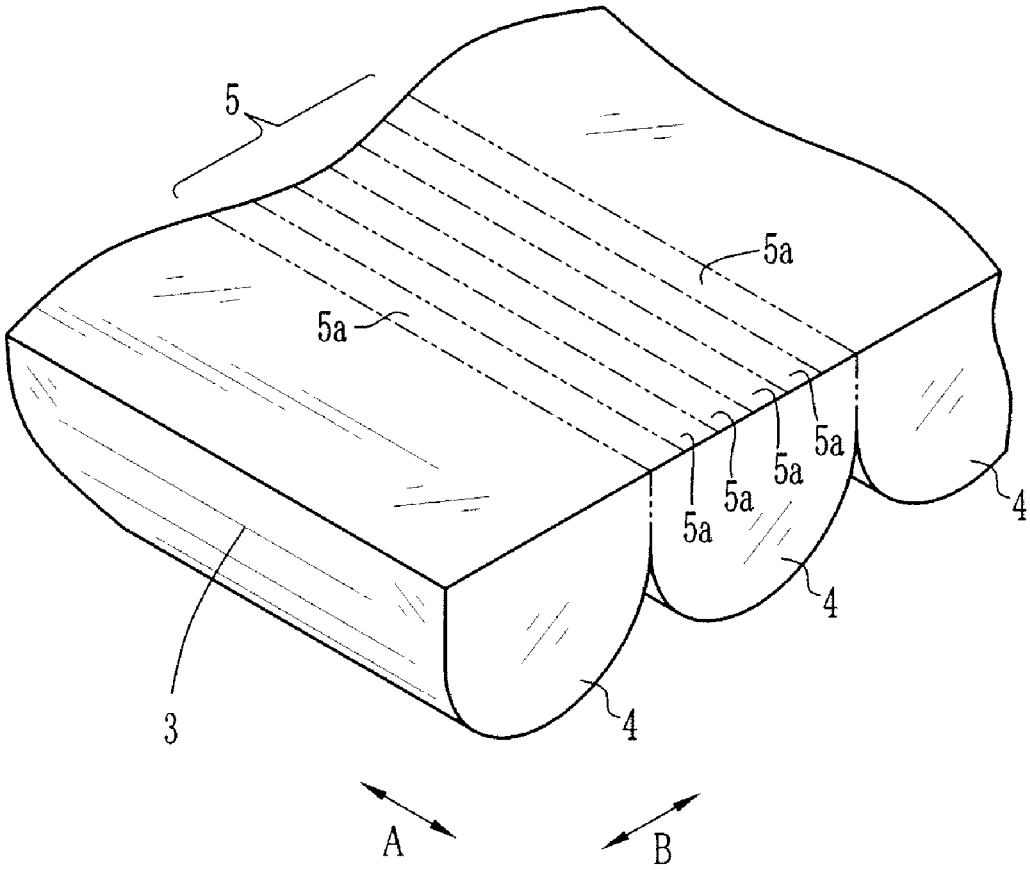
FIG. 2 is a perspective view of a lenticular sheet.

As illustrated in FIG. 2, the lenticular sheet 3 has a plurality of lenticular lenses (hereinafter referred to as the lenses) 4 in the shape of a semicircular column arranged on the front side, and a flat surface on the rear side, as is well known. On the lenticular sheet 3, the lenses 4 elongated in the direction of an arrow A (illustrated in FIG. 2) are arranged at a pitch of 100 LPI (Line Per Inch), for example, in the direction of an arrow B (illustrated in FIG. 2, hereinafter referred to as the arrangement direction). Accordingly, the length of the lens 4 in the arrangement direction is approximately 254 μm, and the lens pitch is also approximately 254 μm. The longitudinal direction (the direction of the arrow A) of the lens 4 is the vertical direction for observing the stereo image, and the arrangement direction of the lens 4 is the horizontal direction for observing the stereo image.

The rear side of the lenticular sheet 3 is imaginary partitioned into image areas 5 each one of which corresponds to each one of the lenses 4. The image area 5 is divided into six minute areas 5*a* along the arrangement direction, and each one of the six minute areas 5*a* corresponds to each one of the six viewpoints for displaying a stereo image. On the each minute area 5*a*, a linear image, which is one of linearly divided parts of a parallax image, is recorded.

As illustrated in FIG. 1, the lenticular sheet 3 is transported to a transport path 12 from a supply opening 11. In the transport path 12, the lenticular sheet 3 with the lens 4 being the bottom face is transported along the arrangement direction of the lens 4. As the transportation of the lenticular sheet 3 to the transport path 12, the lenticular sheet 3 may be automatically transported by a feeding mechanism from a cassette where the lenticular sheets 3 are stacked, or may be inserted manually into the supply opening 11.

In the transport path 12, there is a feeding roller pair 15 near the supply opening 11. The feeding roller pair 15 consists of a capstan roller 15*a* and a pinch roller 15*b*. The capstan roller 15*a* is driven by a motor 16, and the pinch roller 15*b* is rotated following the transportation of the lenticular sheet 3. The pinch roller 15*b* moves between a nip position and a release position. At the nip position, the capstan roller 15*a* and the pinch roller 15*b* nip the lenticular sheet 3 therebetween. At the release position, the pinch roller 15*b* retreats from the lenticular sheet 3.

When the feeding roller pair 15 nips the lenticular sheet 3 in the transport path 12 and the capstan roller 15*a* is driven to rotate by the motor 16, the lenticular sheet 3 is transported downstream (left side in FIG. 1) along the transport path 12. When the leading edge of the lenticular sheet 3 reaches a clamp unit 17 and the clamp unit 17 clamps the lenticular sheet 3, the pinch roller 15*b* moves to the release position to release the nip of the lenticular sheet 3.

The clamp unit 17 includes a clamper 18 (illustrated in FIG. 3) to clamp the leading edge of the lenticular sheet 3 to be transported, a switching mechanism for opening and closing the clamper 18, a rotation mechanism 19 (illustrated in FIG. 3) which rotates the clamper 18 to correct an oblique transportation of the lenticular sheet 3, and the like.

A transport mechanism 20 reciprocates the clamper 18 horizontally along the transport path 12. Accordingly, the lenticular sheet 3 whose leading edge is clamped by the clamper 18 is transported in the transport path 12. The moving direction of the clamper 18 by the transport mechanism 20 is the sub-scanning direction.

When the clamper 18 is moved upstream along the transport path 12, the lenticular sheet 3 is guided into a return path 12*a* which extends obliquely downward from the upstream side of a thermal head 22 (described later). After recording, the lenticular sheet 3 is transported into the return path 12*a*, and is discharged through a discharge opening (not illustrated) by opening (releasing) movement of the clamper 18. Accordingly, to be definite, the lenticular sheet 3 is horizontally transported in the downstream side from the thermal head 22 while recording.

In the upstream side from the clamp unit 17, the thermal head 22 is provided above the transport path 12. In addition, a rotatable platen roller 23 is disposed so as to face the thermal head 22 across the transport path 12.

At the lower part of thermal head 22, a heater element array 22*a* is formed. The heater element array 22*a* has a multitude of heater elements which are arranged in two lines extended in the main-scanning direction (the direction perpendicular to the sub-scanning direction). Due to use of the heater element array 22*a* having the heater elements arranged in two lines, two lines extended in the main-scanning direction can be recorded simultaneously. In accordance with the transportation of the lenticular sheet 3, a row of lines is recorded in the sub-scanning direction.

The length of each line of the heater element array 22*a* is about the same as the length of a recording area of the lenticular sheet 3 in the main-scanning direction. In addition, one pixel, which is recorded by one heater element, has a length of about 20 μm in the sub-scanning direction. Accordingly, one heating of the heater element array 22*a* having two lines of the heater elements records a linear image on one of the minute areas 5*a*. Of course, the thermal head 22 may have the heater element array 22*a* with one line of the heater elements, so as to record one line at a time.

The thermal head 22 moves between a pressing position and a retreat position. At the pressing position, the thermal head 22 presses the rear side of a recording film which is layered on the rear side of the lenticular sheet 3 on the platen roller 23. Then, the thermal head 22 moves upward to the retreat position.

As the recording film, there are an image receptor film 25, an ink film 26, and a back film 27. The films 25 to 27 are attached to a film turning mechanism 28. When the thermal head 22 is at the retreat position, the film turning mechanism 28 rotates so as to move the recording film to be used just under the thermal head 22. In recording, the thermal head 22 moves to the pressing position, such that the recording film just under the thermal head 22 is layered on the rear side of the lenticular sheet 3.

Each recording film has a length approximately equal to the length of the heater element array 22*a* in the main-scanning direction. The recording film having a long length is wound on a spool so that a plurality of the lenticular sheets 3 can be recorded in a single operation. In synchronism with transportation of the lenticular sheet 3, the recording film is fed from one spool and is wound on the other spool.

The image receptor film 25 functions to form an image receptor layer on the rear side of the lenticular sheet 3. To the image receptor layer, colored ink from the ink film 26 is adhered. When the thermal head 22 applies heat to the rear side of the image receptor film 25, with putting the image receptor film 25 on the rear side of the lenticular sheet 3, the transparent image receptor layer is transferred on the rear side of the lenticular sheet 3.

The ink film 26 is a well-known sublimation type, on which there is a plurality of sets of a yellow ink region, a magenta ink region, and a cyan ink region arranged in sequential order along the longitudinal direction thereof. Each ink region has an approximately same size as the lenticular sheet 3. After forming the image receptor layer on the lenticular sheet 3, the thermal head 22 heats the ink film 26 to sublimate the inks of yellow, magenta, and cyan. The sublimated inks are adhered onto the image receptor layer. Through changing a heating value of each heater element of the thermal head 22, a density (an adhered ink amount) of each pixel recorded on the image receptor layer can be controlled.

The back film 27 is layered on the rear side of the lenticular sheet 3 on which the image is recorded by the ink film 26. When the thermal head 22 applies heat to the rear side of the back film 27, the white back layer is transferred on the rear side of the lenticular sheet 3.

To a data converter 31, parallax image data of two viewpoints is input. The data converter 31 converts the parallax image data of two viewpoints into image data of six viewpoints through image processing. The converted image date is sent to a head driver 32.

The head driver 32 drives the thermal head 22. When forming the image receptor layer and the back layer, the head driver 32 controls the thermal head 22, such that the heater elements concurrently generate adequate amounts of heat to transfer the image receptor layer and the back layer. When recording an image with use of the ink film 26, the head driver 32 controls the thermal head 22 based on the parallax image data of six viewpoints to record three colors in a frame sequential order.

A measuring unit 34 is provided between the thermal head 22 and the clamp unit 17. The measuring unit 34 functions for optically detecting an oblique transportation angle of the lenticular sheet 3. The measuring unit 34 includes a sensor unit 36 and a sensor moving mechanism 37 (see FIG. 6) which moves the sensor unit 36 along the main-scanning direction.

The sensor unit 36 includes a light projector 36*a* and a light receiver 36*b*. The light projector 36*a* has a light emitting element such as a light emitting diode, and projects inspection light toward the lenticular sheet 3. The light receiver 36*b* receives the inspection light having transmitted through the lenticular sheet 3, and outputs a detection signal corresponding to intensity of the received inspection light. The sensor unit 36 is moved by the sensor moving mechanism 37 in synchronism with transportation of the lenticular sheet 3 while forming the image receptor layer. Accordingly, the sensor unit 36 is moved relative to the lenticular sheet 3 along a predetermined inspection scanning direction, for inspection scanning.

When recording a parallax image, the sensor unit 36 is used as a sensor for detecting a positional relationship between the image area 5 and the heater element array 22*a*. According to the detection result, drive timing of the thermal head 22 and transportation of the lenticular sheet 3 are controlled, such that each of linear images is correctly recorded on one of the image areas 5 on which these linear images should be recorded.

A controller 35 controls each part of the printer 2. The controller 35 calculates an oblique transportation angle (a shift angle between the main-scanning direction and the longitudinal direction of the lens 4) based on the detection signal from the sensor unit 36 in the inspection scanning. According to the calculation result, the controller 35 controls the rotation mechanism 19 to rotate the clamper 18 such that the longitudinal direction of the lens 4 becomes parallel to the main-scanning direction.

Figure 3:
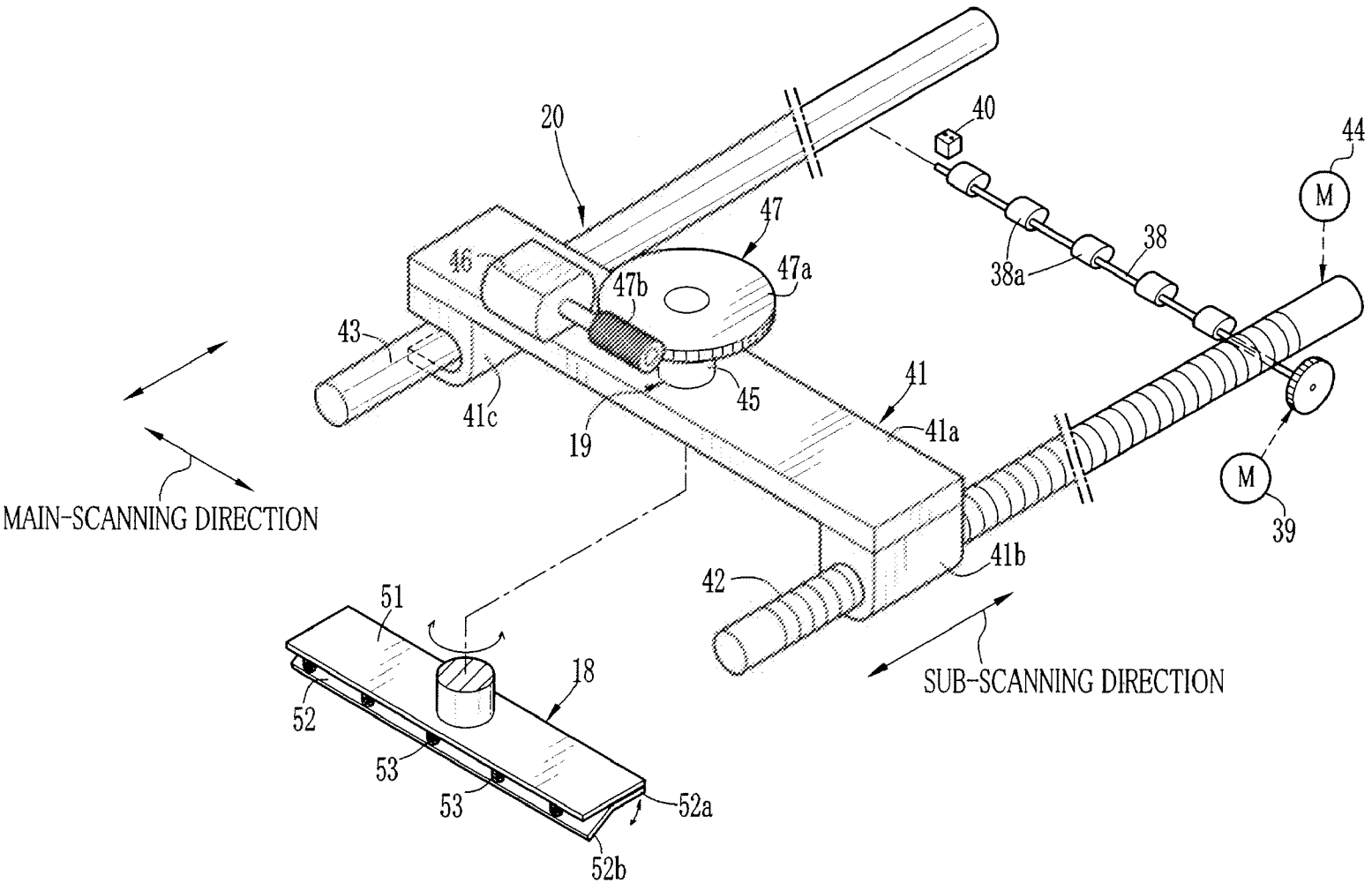
FIG. 3 is a perspective view which illustrates a clamper unit and a transportation mechanism.

FIG. 3 illustrates the clamp unit 17 and the transport mechanism 20. The clamp unit 17 includes the clamper 18, the rotation mechanism 19, a camshaft 38, an unclamp motor 39, an edge detecting sensor 40, and the like. The transport mechanism 20 includes a movable stage 41, a lead screw 42, a guide shaft 43, a transport motor 44, and the like.

The movable stage 41 includes a base plate 41*a* whose long side is along the main-scanning direction, and a feed member 41*b* and a guide member 41*c* which are integrally attached to both ends of the bottom surface of the base plate 41*a*. The lead screw 42 and the guide shaft 43 extend horizontally along the sub-scanning direction. The lead screw 42 and the guide shaft 43 are disposed so as to be in parallel with each other across the transport path 12. The lead screw 42 passes through a screw hole provided in the feed member 41*b*, and the guide shaft 43 passes through a groove provided in the guide member 41*c*. Accordingly, the movable stage 41 is movable along the sub-scanning direction.

The transport motor 44 rotates by drive pulses supplied from the controller 35. The movable stage 41 is moved downstream along the transport path 12 by normal rotation of the transport motor 44, and is moved upstream along the transport path 12 by reverse rotation of the transport motor 44. The controller 35 moves the movable stage 41 downstream when forming the image receptor layer and the back layer, and recording images.

Note that moving amount of the movable stage 41 can be finely controlled. Accordingly, fine control of a position of the lenticular sheet 3 can be performed such that a single linear image including two lines is recorded correctly in a single minute area 5*a*.

The rotation mechanism 19 includes a rotation shaft 45, a motor 46, and a worm gear 47. The rotation shaft 45 is provided at the center of the base plate 41*a* so as to be rotatable around the vertical axis. To the upper side of the rotation shaft 45, a worm wheel 47*a* of the worm gear 47 is fixed. A worm 47*b* fixed to the output shaft of the motor 46 is engaged with the worm wheel 47*a*.

The rotation shaft 45 penetrates through the base plate 41*a*, and the clamper 18 is attached to the lower end of the rotation shaft 45. Accordingly, the clamper 18 is rotatable on the transportation surface of the lenticular sheet 3 which is horizontal. When the controller 35 drives the motor 46, the clamper 18 and the lenticular sheet 3 clamped by the clamper 18 are rotated on the transportation surface, such that the oblique transportation of the lenticular sheet 3 is corrected. As described above, the simple mechanism which rotates the clamper 18 makes correction of the oblique transportation of the lenticular sheet 3.

Note that as the rotation mechanism 19, any other configuration can be adopted as long as it can rotate the lenticular sheet 3 through rotation of the clamper 18.

The clamper 18 includes a stationary plate 51, a movable plate 52, and a spring 53. The stationary plate 51 is a flat plate whose length in the main-scanning direction is approximately equal to the width of the lenticular sheet 3. The rotation shaft 45 is attached to the center of the upper surface of the stationary plate 51. The stationary plate 51 is parallel to the transportation surface.

The movable plate 52 has the length equal to that of the stationary plate 51 in the main-scanning direction, and is bent down in the sub-scanning direction. The movable plate 52 is swingably attached to the lower surface of the stationary plate 51 through a shaft 54 (see FIG. 4) positioned along the bent edge portion of the movable plate 52, and swings between a release position where an upstream side edge portion 52*a* is apart from the stationary plate 51 and a clamp position where the upstream side edge portion 52*a* is close to the stationary plate 51. A spring 53 is provided between the stationary plate 51 and a downstream side edge portion 52*b* to apply a bias force for moving the movable plate 52 toward the clamp position.

The clamper 18 moves integrally with the movable stage 41 between a working position and an end position downstream from the working position. In the working position, the movable plate 52 is moved between the clamp position and the release position. Through the movement of the clamper 18 between the working position and the end position, the lenticular sheet 3 clamped by the clamper 18 is transported.

At the working position, there is a camshaft 38 for rotating the movable plate 52. A cam 38*a* provided to the camshaft 38 contacts the lower surface of the downstream side edge portion 52*b* when the clamper 18 is at the working position. When the camshaft 38 is rotated by the unclamp motor 39 while the clamper 18 is at the working position, the movable plate 52 is moved to the release position since the downstream side edge portion 52*b* is pushed up against the bias force of the spring 53 (illustrated in FIG. 4). When the camshaft 38 is further rotated as illustrated in FIG. 5, the bias force of the spring 53 moves the movable plate 52 to the clamp position.

Figure 4:
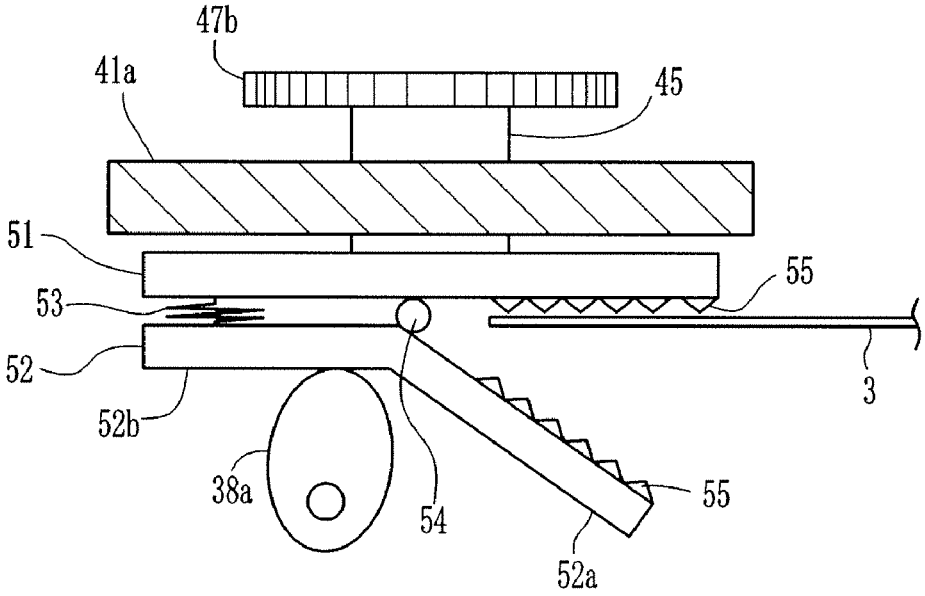
FIG. 4 is an explanatory drawing which illustrates the clamper when a movable plate is at a release position.
Figure 5:
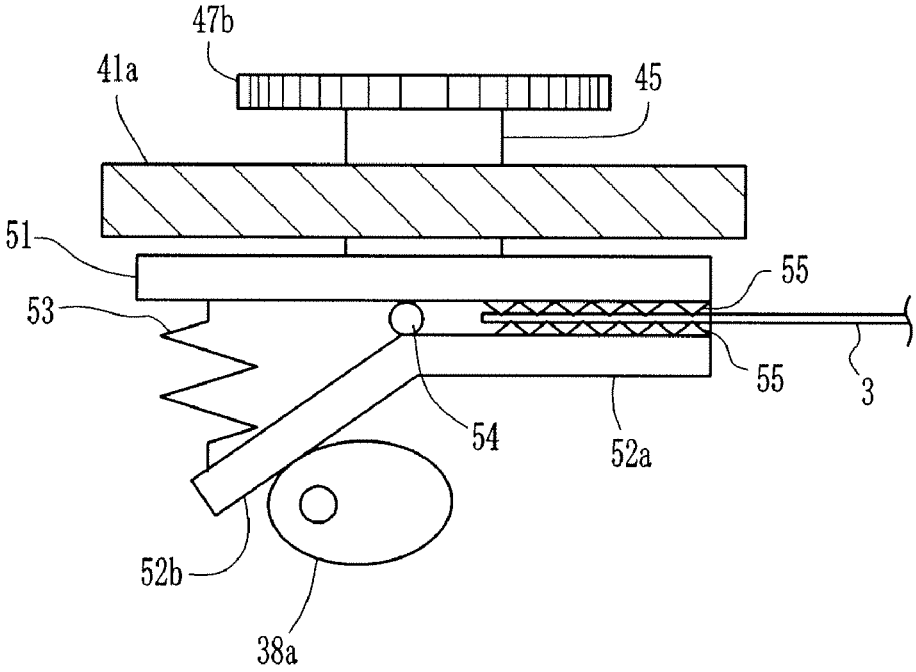
FIG. 5 is an explanatory drawing which illustrates the clamper when the movable plate is at a clamp position.

Note that a member denoted by the reference numeral 55 in FIGS. 4 and 5 is an anti-slip member for preventing a slip of the lenticular sheet 3 while being clamped.

In the above embodiment, the switching mechanism of the clamper 18 moves the movable plate 52 between the clamp position and the release position with use of the spring 53, the camshaft 38, and the unclamp motor 39. However, configurations of the clamper 18 and the switching mechanism are not limited to this embodiment. For example, the clamper 18 may be switched such that a fixed member (not illustrated) contacts and pushes up the movable plate 52 toward the release position against the bias force of the spring 53 when the clamper 18 reaches the working position, and the contact between the fixed member and the clamper 18 is released and the clamper 18 switches to the clamp position when the clamper 18 slightly moves downstream from the working position. Also, a motor or the like may directly switches the clamper 18 between the clamp position and the release position.

The edge detecting sensor 40 is provided to control clamp timing of the clamper 18. In feeding, the controller 35 moves the clamper 18 to the working position, and rotates the camshaft 38 when a transportation length of the lenticular sheet 3 reaches a predetermined length after the edge detecting sensor 40 detects the leading edge of the lenticular sheet 3. Since the camshaft 38 rotates, the movable plate 52 switches to the clamp position from the release position so that the clamper 18 clamps the leading edge of the lenticular sheet 3.

Note that the transportation length of the lenticular sheet 3 in feeding can be calculated from the number of drive pulses applied to the motor 16 which drives the feeding roller pair 15. In the transportation with use of the transport mechanism 20, the transportation length of the lenticular sheet 3 can be calculated from the number of drive pulses applied to the transport motor 44.

Figure 6:
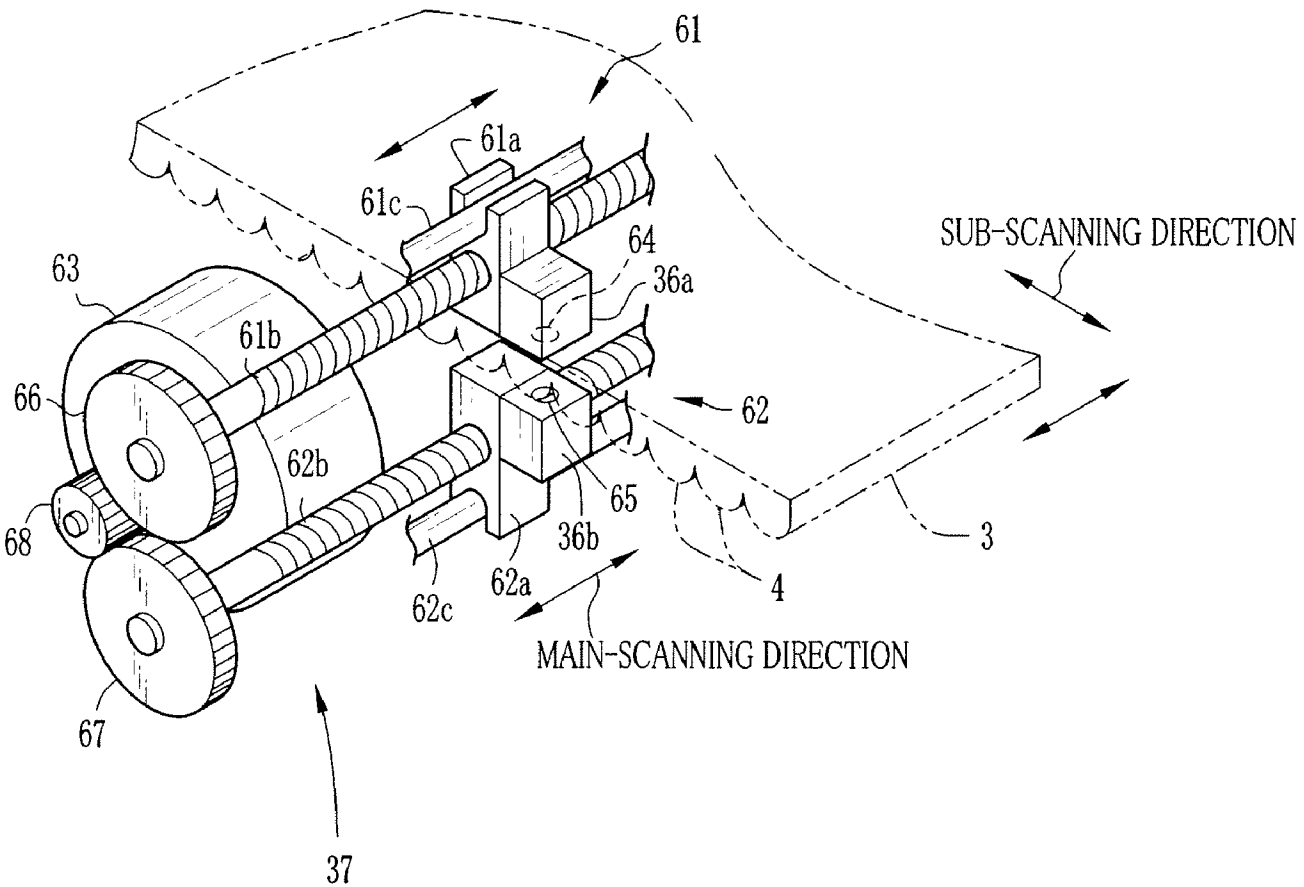
FIG. 6 is a perspective view which illustrates a sensor moving mechanism for moving a sensor.

FIG. 6 illustrates the measuring unit 34. The sensor moving mechanism 37 functions to move the sensor unit 36 in the main-scanning direction, and includes a light projecting unit 61, a light receiver unit 62, a motor 63, and the like.

The light projecting unit 61 includes a feed member 61*a* having a side surface on which the light projector 36*a* is attached, a lead screw 61*b*, and a guide shaft 61*c*. The lead screw 61*b* and the guide shaft 61*c* are provided horizontally along the main-scanning direction above the transport path 12. The feed member 61*a* has a screw hole through which the lead screw 61*b* passes, and a guide groove through which the guide shaft 61*c* passes. Accordingly, when the lead screw 61*b* rotates, the feed member 61*a* moves along the main-scanning direction. The light projector 36*a* has a lower surface on which an irradiation hole 64 is provided. Through the irradiation hole 64, the light projector 36*a* projects inspection light downward.

The light receiver unit 62 has the same configuration as that of the light projecting unit 61, and includes a feed member 62*a*, a lead screw 62*b* for moving the feed member 62*a* horizontally along the main-scanning direction, and a guide shaft 62*c*. The lead screw 62*b* and the guide shaft 62*c* are provided below the transport path 12. The light receiver 36*b* is attached on a side surface of the feed member 62*a*, and has a light access hole 65 on its upper surface. Through the light access hole 65, the light receiver 36*b* receives the inspection light having passed through the lenticular sheet 3.

To the end of each of the lead screws 61*b* and 62*b*, a gear 66 and a gear 67 are respectively fixed. The gears 66 and 67 are interlocked with a gear 68 which is attached to an output shaft of the motor 63. Therefore, in accordance with rotation of the motor 63, the light projector 36*a* and the light receiver 36*b* move the same distance in the same direction. The light projector 36*a* and the light receiver 36*b* are positionally adjusted such that they face each other across the lenticular sheet 3. The sensor unit 36 moves with keeping this positional relationship between the light projector 36*a* and the light receiver 36*b*.

The sensor unit 36 is controlled to move in synchronism with the transportation of the lenticular sheet 3 which is performed by the transport mechanism 20. Specifically, the sensor unit 36 moves a predetermined distance in the main-scanning direction while the transport mechanism 20 transports the lenticular sheet 3 a distance of two lines in the sub-scanning direction, such that the transportation length of the lenticular sheet 3 and the moving distance of the sensor unit 36 are in proportion. Accordingly, the sensor unit 36 moves relative to the lenticular sheet 3 in a measurement scanning direction having a constant measurement scanning angle against the main-scanning direction. The measurement scanning angle is sufficiently larger than an assumed oblique transportation angle.

Note that the configuration of the sensor unit 36 is not limited above as long as the detection signal corresponding to the concave-convex surface (due to the lens 4) of the lenticular sheet 3 can be obtained. For example, a configuration described below may be used. The light projector 36*a* and the light receiver 36*b* are provided above the transport path 12, and a reflective plate is provided below the transport path 12, such that the inspection light from the light projector 36*a* passes through the lenticular sheet 3 and is reflected on the reflective plate, and then the reflected light passes through the lenticular sheet 3 and is received by the light receiver 36*b*. In addition, the light projector 36*a* is not required to face the light receiver 36*b*. The light projector 36*a* can be shifted relative to the light receiver 36*b* in each of the main-scanning direction and the sub-scanning direction.

Figure 7:
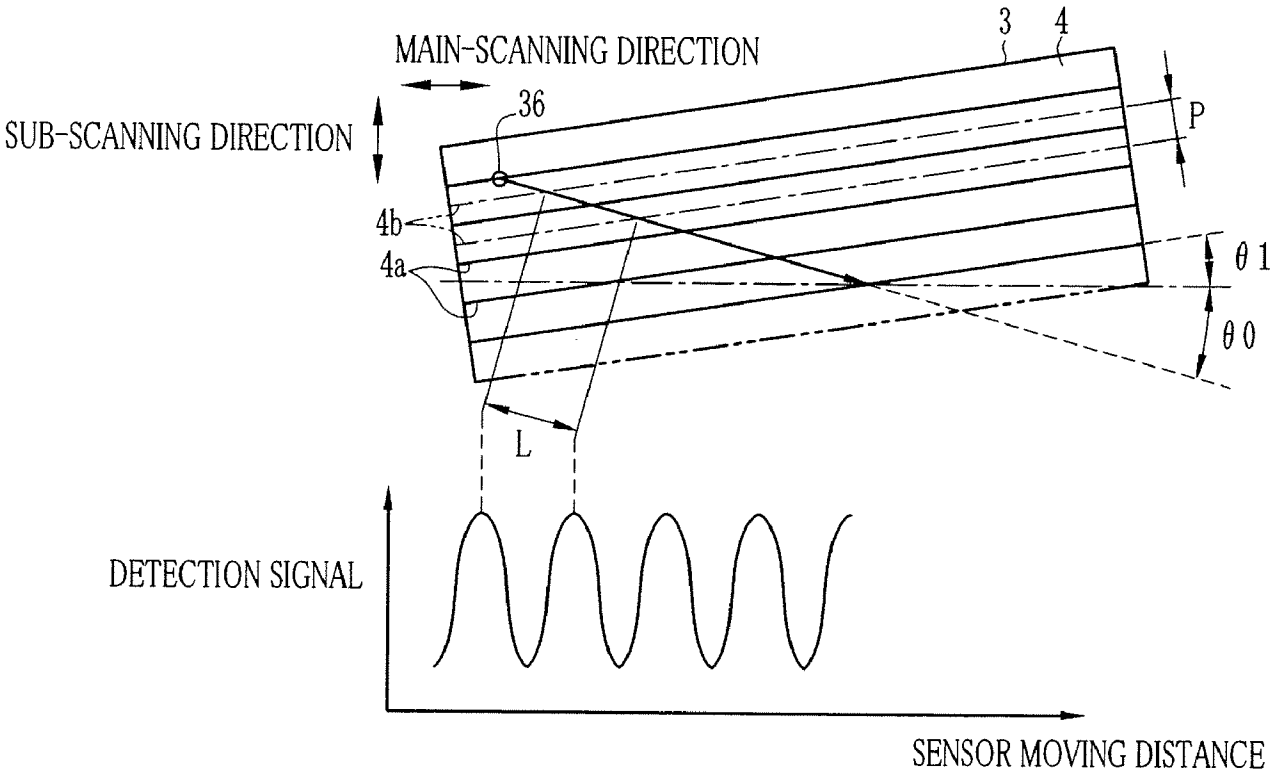
FIG. 7 is an explanatory drawing which illustrates a relation between a detection signal and a position of the sensor relative to the lenticular sheet.

According to a positional relationship between the sensor unit 36 and the lens 4, an amount of the inspection light received by the light receiver 36*b* varies, and the detection signal varies in accordance with the amount of the received inspection light. As illustrated in FIG. 7, while the sensor unit 36 moves in the measurement scanning direction and traverses the lens 4, the detection signal periodically varies as described below. The detection signal gradually increases when the sensor unit 36 moves from a position facing a boundary 4*a* of the lenses 4 to a position facing a vertex 4*b* of the lens 4. When the sensor unit 36 faces the vertex 4*b*, the detection signal reaches a peak. Then, the detection signal gradually decreases until the sensor unit 36 faces the boundary 4*a*. After the sensor unit 36 passed through the boundary 4*a*, the detection signal gradually increases again.

As described above, to obtain the detection signal, the sensor unit 36 scans the convex and concave of the lens 4. This configuration contributes to downsize and lighten the entire apparatus as compared with a configuration which uses a plurality of fixed sensors to obtain signals for detecting the oblique transportation. In addition, the configuration with the plurality of fixed sensors can only perform an intermittent detection, and obtains detection results with low accuracy, because an interval between the sensors affects an accuracy of the detection. However, the configuration of this embodiment using scanning has not these problems.

The controller 35 calculates an oblique transportation angle θ1 of the lenticular sheet 3 from the detection signal which varies as described above. The controller 35 controls the rotation mechanism 19 to rotate the clamper 18 in a direction such that the oblique transportation angle θ1 becomes zero (that is, the clamper 18 rotates by −θ1 degrees). As describe above, the control for correction of the oblique transportation of the lenticular sheet 3 can be performed by the simple solution, that is, the clamper 18 is rotated by −θ1 degrees.

The oblique transportation angle θ1 can be expressed as a following Formula 1:

$$\theta 1 = \mathrm{Sin}^{-1}(P/L) - \theta 0 \qquad \text{[Formula 1]}$$

wherein L is a transportation length of the sensor unit 36 relative to the lenticular sheet 3 while one cycle of the detection signal as illustrated in FIG. 7 (for example, peak to peak) is detected, θ0 is the measurement scanning angle, and P is the lens pitch of the lenticular sheet 3.

Note that, the measurement scanning angle θ0 is a predetermined value which is determined by a ratio between the transportation length of the lenticular sheet 3 in the sub-scanning direction and the transportation length of the sensor unit 36 in the main-scanning direction. In addition, the transportation length L can be calculated by counting pulses fed to the transport motor 44 and the motor 63. As the transportation length L of one cycle, an average transportation length between peaks can be applied. By observing a number of peaks and calculating the average transportation length, the oblique transportation angle θ1 can be calculated with high accuracy.

Due to the measurement scanning angle θ0, a large scanning width of the sensor unit 36 can be obtained. In addition, when the average transportation length of a number of peaks is used, accuracy of detection of the oblique transportation angle θ1 can be improved. The measurement scanning angle θ0 is preferably no more than 45°, such that a transportation length of the lenticular sheet 3 relative to each of the lens 4 is lengthened to improve detection accuracy.

Note that one cycle of the detection signal for calculating the transportation length L is not limited to peak to peak. For example, the bottom of the detection signal which corresponds to the boundary 4*a* of the lens 4 can be used. Another example of simple method is that the detection signal is classified into two values by a predetermined threshold value, and rise point to rise point or fall point to fall point of the signal is determined as one cycle.

Next, an operation of the above embodiment will be described. Parallax image data of two viewpoints of an image which will be recorded is input and converted into parallax image data of six viewpoints. The converted parallax image data of six viewpoints is sequentially sent to the head driver 32.

When a command to start print is given, it is confirmed that the thermal head 22 is at the retreat position. In addition, after the clamper 18 is adjusted to be approximately parallel to the main-scanning direction based on a detection result of an encoder (not illustrated) or the like, the transport mechanism 20 is actuated to move the clamper 18 to the working position. After the clamper 18 reaches the working position, the unclamp motor 39 rotates the camshaft 38. Accordingly, the movable plate 52 is moved to the release position, since the downstream side edge portion 52*b* is pushed up by the cam 38*a* against the bias force of the spring 53.

After the movable plate 52 reaches the release position, one of the lenticular sheets 3 is fed into the transport path 12 through the supply opening 11. The fed lenticular sheet 3 is transported downstream in the transport path 12 by the feeding roller pair 15. In this transportation, the lenticular sheet 3 passes between the platen roller 23 and the thermal head 22 being at the retreat position, and between the light projector 36*a* and the light receiver 36*b*. Then, the leading edge of the lenticular sheet 3 reaches the clamp unit 17.

When the edge detecting sensor 40 detects the leading edge of the lenticular sheet 3, the controller 35 controls the feeding roller pair 15 to further transport the lenticular sheet 3 by the predetermined length such that the leading edge of the lenticular sheet 3 enters between the stationary plate 51 and the movable plate 52. After that, the transportation is halted.

After the transportation is halted, the unclamp motor 39 rotates the camshaft 38 again so that the movable plate 52 turns to the clamp position since the downstream side edge portion 52*b* is pushed down by the bias force of the spring 53. Thereby, the leading edge of the lenticular sheet 3 is clamped between the stationary plate 51 and the movable plate 52. After that, the feeding roller pair 15 releases the nipping of the lenticular sheet 3.

Next, the film turning mechanism 28 is activated so as to position the image receptor film 25 just under the thermal head 22. Then, the thermal head 22 is moved to the pressing position. Accordingly, the thermal head 22 presses the rear side of the lenticular sheet 3 through the image receptor film 25.

After that, the transport motor 44 rotates to move the clamper 18 integrated with the movable stage 41 downstream. Accordingly, the lenticular sheet 3 is transported in the sub-scanning direction. Also, the image receptor film 25 is transported to follow the transportation of the lenticular sheet 3.

During this transportation, when a portion of the lenticular sheet 3 preceding few lines from the recording area reaches the thermal head 22, the head driver 32 drives the heater element array 22*a* to heat the image receptor film 25. Thereby, two lines of the transparent image receptor layer extending along the main-scanning direction are formed on the rear side of the lenticular sheet 3 by transcription.

After forming two lines of the image receptor layer, the transport motor 44 rotates to move the clamper 18 integrated with the movable stage 41 downstream by a length corresponding to the two lines. Again, the heater element array 22*a* heats the image receptor film 25, such that newly-formed two lines of the image receptor layer are arrayed next to the former-formed two lines of the image receptor layer in the sub-scanning direction. In the same way, while transporting the lenticular sheet 3 in the sub-scanning direction, lines of the image receptor layer are formed, two at a time.

While forming the image receptor layer as described above, the measurement scanning is performed under the control of the controller 35. The controller 35 drives the transport motor 44 and the motor 63, such that the sensor unit 36 moves the predetermined length in the main-scanning direction while the lenticular sheet 3 is moved by the length corresponding to two lines in the sub-scanning direction. The movement of the sensor unit 36 is performed in a sequential manner for each movement of the lenticular sheet 3.

Accordingly, while the sensor unit 36 moves in the measurement scanning direction relative to the lenticular sheet 3, the light projector 36*a* projects the inspection light toward the lenticular sheet 3, and the light receiver 36*b* outputs the detection signal corresponding to the intensity of the inspection light having passed through the lenticular sheet 3. Note that, if the sensor unit 36 scans a portion of the lenticular sheet 3 where the image receptor layer is formed, it does not affect the detection signal because the image receptor layer is transparent.

When the measurement scanning is started, the controller 35 refers the detection signal from the light receiver 36*b*, and counts the transportation length of the sensor unit 36 in the measurement scanning direction based on the detection signal. For example, counting of the transportation length of the sensor unit 36 in the direction of the measurement scanning angle θ0 is started from the first peak of the detection signal detected at a preferred timing, and is finished when (M+1)th peak is detected. Then, the average transportation length of one section is calculated from the transportation length of the counted M sections, and the average transportation length is determined as the transportation length L.

Since the lenticular sheet 3 is tensioned properly between the clamper 18 and the thermal head 22, the lenticular sheet 3 has no deflection. Accordingly, the transportation length L can be accurately measured in consideration of elongation of the lenticular sheet 3. In addition, since change of the continuous detection signal from the single light receiver 36*b* is detected, the transportation length L can be measured with minimized error.

Then, the controller 35 calculates the oblique transportation angle θ1 according to Formula 1 with use of the transportation length L calculated as described above, and the measurement scanning angle θ0 and the lens pitch P which are predetermined. When the oblique transportation angle θ1 is calculated, the controller 35 sends drive pulses to the motor 46 to rotate the clamper 18 by −θ1 degree. In Accordance with the rotation of the clamper 18, the lenticular sheet 3 whose leading edge is clamped by the clamper 18 is rotated by −θ1 degrees on the transportation surface. At this time, although the lenticular sheet 3 is nipped between the thermal head 22 and the platen roller 23, this nipping pressure is not so high that the lenticular sheet 3 slightly slides on these members. Therefore, the lenticular sheet 3 can rotate on the transportation surface.

As a result, while forming the image receptor layer, the lenticular sheet 3 rotates by −θ1 degree on the transportation surface, such that the longitudinal direction of the lens 4 becomes parallel to the main-scanning direction. In this embodiment, since the measurement scanning by the sensor unit 36 and the correction of the oblique transportation by rotation of the clamper 18 are performed while forming the image receptor layer, printing time can be reduced. However, these operations may be performed at another time separately from the formation of the image receptor layer. For example, the oblique transportation may be corrected while the lenticular sheet 3 is returned upstream after formation of the image receptor layer.

When forming of the image receptor layer on the recording area is finished, the transportation of the lenticular sheet 3 by the transport mechanism 20 is halted, and then the thermal head 22 moves to the retreat position. Thereafter, the transport motor 44 rotates reversely to move upstream the movable stage 41 together with the clamper 18. In accordance with this, the lenticular sheet 3 is transported upstream along the transport path 12. At this time, a trailing edge of the lenticular sheet 3 is guided to enter into the return path 12*a*. When the leading edge of the recording area of the lenticular sheet 3 reaches the position of the thermal head 22, the reverse rotation of the transport motor 44 is halted.

After the film turning mechanism 28 moves the ink film 26 to a position just under the thermal head 22, the thermal head 22 is moved to the pressing position. At this time, the yellow ink region is layered on the rear side of the lenticular sheet 3.

In addition, the sensor unit 36 is moved by the sensor moving mechanism 37 to a specific position, for example, approximately the center of the recording area in the main-scanning direction. Then, the transport motor 44 rotates to transport downstream the lenticular sheet 3 clamped by the clamper 18, while the sensor unit 36 is stayed at the specific position.

During the above-described transportation, the sensor unit 36 performs the projection and reception of the inspection light, and the controller 35 refers to the detection signal. When the peak of the detection signal is detected, a displacement degree between the heater element array 22*a* and the minute area 5*a* is calculated based on the lens pitch P and a distance from the specific (predetermined) position of the sensor unit 36 to the heater element array 22*a*. Then, a rotation amount of the transport motor 44 is controlled to correct the displacement. After that, the transport motor 44 is driven to transport the lenticular sheet 3, by two lines at a time.

In the above-described transportation by two lines at a time, when the heater element array 22*a* is positioned on the first minute area 5*a* of the image area 5 in the recording area, recording of a yellow image is started. The yellow image is recorded such that the yellow ink is sublimated from the ink film 26 and deposited onto the image receptor layer by driving the thermal head 22 based on yellow image data contained in image data which is input into the head driver 32. Linear images are sequentially recorded on each minute area 5*a*, such that two lines extending in the main-scanning direction are recorded concurrently, by driving two lines of the heater element array 22*a* based on the yellow image data of the two lines, in accordance with each of transportations (corresponding to two lines) of the lenticular sheet 3.

After the last line of the yellow image is recorded, the transportation of the lenticular sheet 3 is halted, and then the thermal head 22 is moved to the retreat position. After that, the clamper 18 is moved upstream together with the movable stage 41, to transport the lenticular sheet 3 upstream in the transport path 12. When the leading edge of the recording area passes the position of the thermal head 22, the transportation of the lenticular sheet 3 is halted.

After feeding the ink film 26 such that the magenta ink region is positioned on the rear side of the lenticular sheet 3, the thermal head 22 is moved to the pressing position. Then, the lenticular sheet 3 is moved in the sub-scanning direction so as to correct the displacement between the heater element array 22*a* and the minute area 5*a*, and is transported by two lines at a time, as in the case of the yellow image. During the transportation, the thermal head 22 is driven based on magenta image data to record the magenta image on the recording area of the lenticular sheet 3.

After finishing the recording of the magenta image, the lenticular sheet 3 is transported upstream once, and then the lenticular sheet 3 is transported downstream again, through the same procedure described above. After feeding the ink film 26 such that the cyan ink region is positioned on the rear side of the lenticular sheet 3, the thermal head 22 is moved to the pressing position. While the lenticular sheet 3 is transported downstream, the thermal head 22 is driven based on cyan image data to record a cyan image, by two lines at a time.

As described above, each color of image is recorded by two lines at a time. In this recording, since the longitudinal direction of each lens 4 of the lenticular sheet 3 which is in the transportation is parallel to the main-scanning direction, each line is recorded by the thermal head 22 without running out from the minute area 5*a*.

After recording the three-color image on the recording area, the lenticular sheet 3 is transported upstream once, and then the lenticular sheet 3 is transported downstream again, through the same procedure described above. In addition, the back film 27 is moved to the position just under the thermal head 22 by the film turning mechanism 28, and then the thermal head 22 is moved to the pressing position. While the lenticular sheet 3 is transported downstream, the thermal head 22 is driven so as to form the back layer on the recording area on which the three-color image is recorded.

After forming the back layer, the thermal head 22 is moved to the retreat position, and then the clamper 18 is moved toward the working position by the transport mechanism 20, while guiding the lenticular sheet 3 into the return path 12*a*. After that, the camshaft 38 is rotated, and thereby, the cam 38*a* pushes up the downstream side edge portion 52*b* against the bias force of the spring 53, and the movable plate 52 is moved to the release position. Accordingly, the clamp of the leading edge of the lenticular sheet 3 is released, and the lenticular sheet 3 is discharged from the discharge opening.

In the above embodiment, movement of the sensor unit 36 along the main-scanning direction by the sensor moving mechanism 37, and transportation of the lenticular sheet 3 along the sub-scanning direction by the transport mechanism 20 are performed concurrently. Accordingly, the sensor unit 36 is moved relative to the lenticular sheet 3 in the measurement scanning direction which has the measurement scanning angle θ0 from the main-scanning direction. However, a moving direction itself of the sensor unit 36 by the sensor moving mechanism 37 may be tilted against the main-scanning direction, so that the sensor unit 36 moves relative to the lenticular sheet 3 in the measurement scanning direction which has the measurement scanning angle θ0. In this case, the sensor unit 36 is moved while the transportation of the lenticular sheet 3 is halted.

[Second Embodiment]

Figure 8:
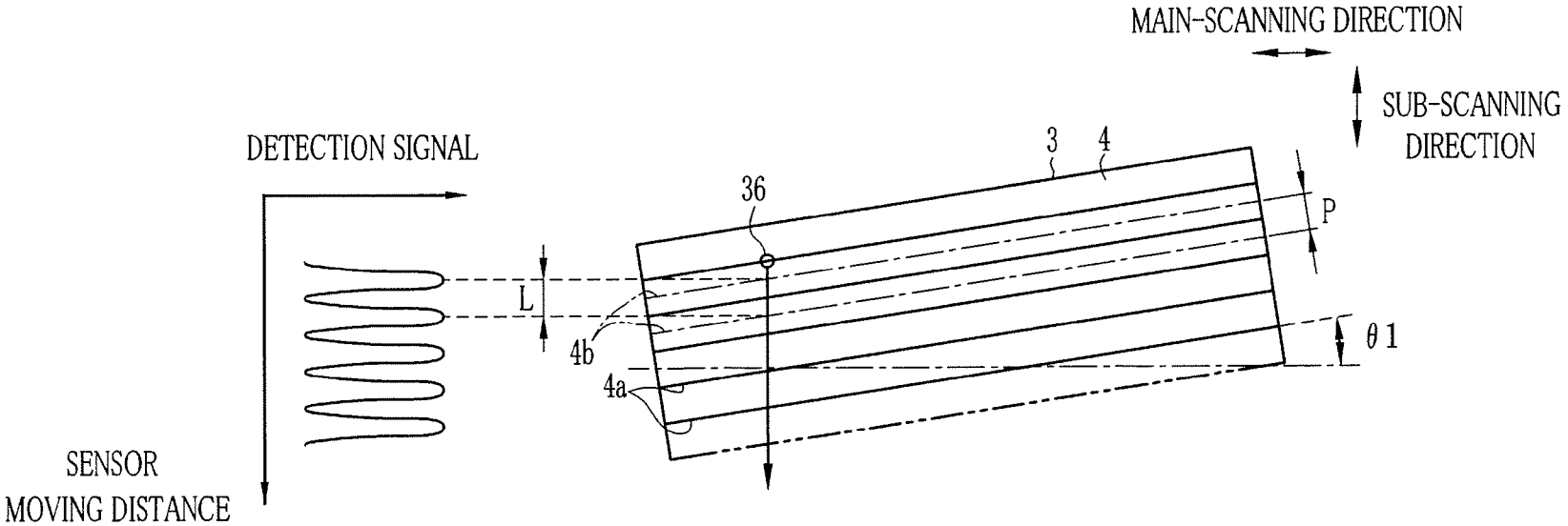
FIG. 8 is an explanatory drawing which illustrates a relation between a detection signal and a position of the sensor, which relatively moves in a main-scanning direction, relative to the lenticular sheet.

A second embodiment is illustrated in FIG. 8. In this embodiment, the sensor unit 36 is moved in the sub-scanning direction (the direction perpendicular to the longitudinal direction of the lens 4) relative to the lenticular sheet 3 to obtain the detection signal, such that the oblique transportation angle θ1 of the lenticular sheet 3 is calculated from the obtained detection signal. In this case, the oblique transportation angle θ1 can be expressed as a following Formula 2:

$$\theta 1 = \mathrm{Cos}^{-1}(P/L) \qquad \text{[Formula 2]}$$

wherein L is a transportation length of the sensor unit 36 in the sub-scanning direction while one cycle of the detection signal (for example, peak to peak) is detected, and P is the lens pitch of the lenticular sheet 3.

In order to move the sensor unit 36 in the sub-scanning direction relative to the lenticular sheet 3, a sensor moving mechanism for moving the sensor unit 36 in the sub-scanning direction may be provided, such that the sensor unit 36 is moved while the transportation of the lenticular sheet 3 is halted, or the sensor unit 36 may be held while the lenticular sheet 3 is transported in the sub-scanning direction by the transport mechanism 20. There is no doubt that, while the lenticular sheet 3 is transported in the sub-scanning direction, the sensor unit 36 may be moved in the direction opposite to the sub-scanning direction.

In case that the sensor unit 36 is moved in the sub-scanning direction relative to the lenticular sheet 3, in which rotational direction the lenticular sheet 3 has the oblique transportation cannot be found from the calculation of the oblique transportation angle θ1. Therefore, in this case, the clamper 18 rotates the lenticular sheet 3 by predetermined degrees (for example by degrees corresponding to the oblique transportation angle θ1) in one direction, and then the calculation of the oblique transportation angle is performed again. If a larger oblique transportation angle is obtained, the lenticular sheet 3 may be rotated by degrees corresponding to the oblique transportation angle θ1 in the opposite direction from the initial state.

[Third Embodiment]

Figure 9:
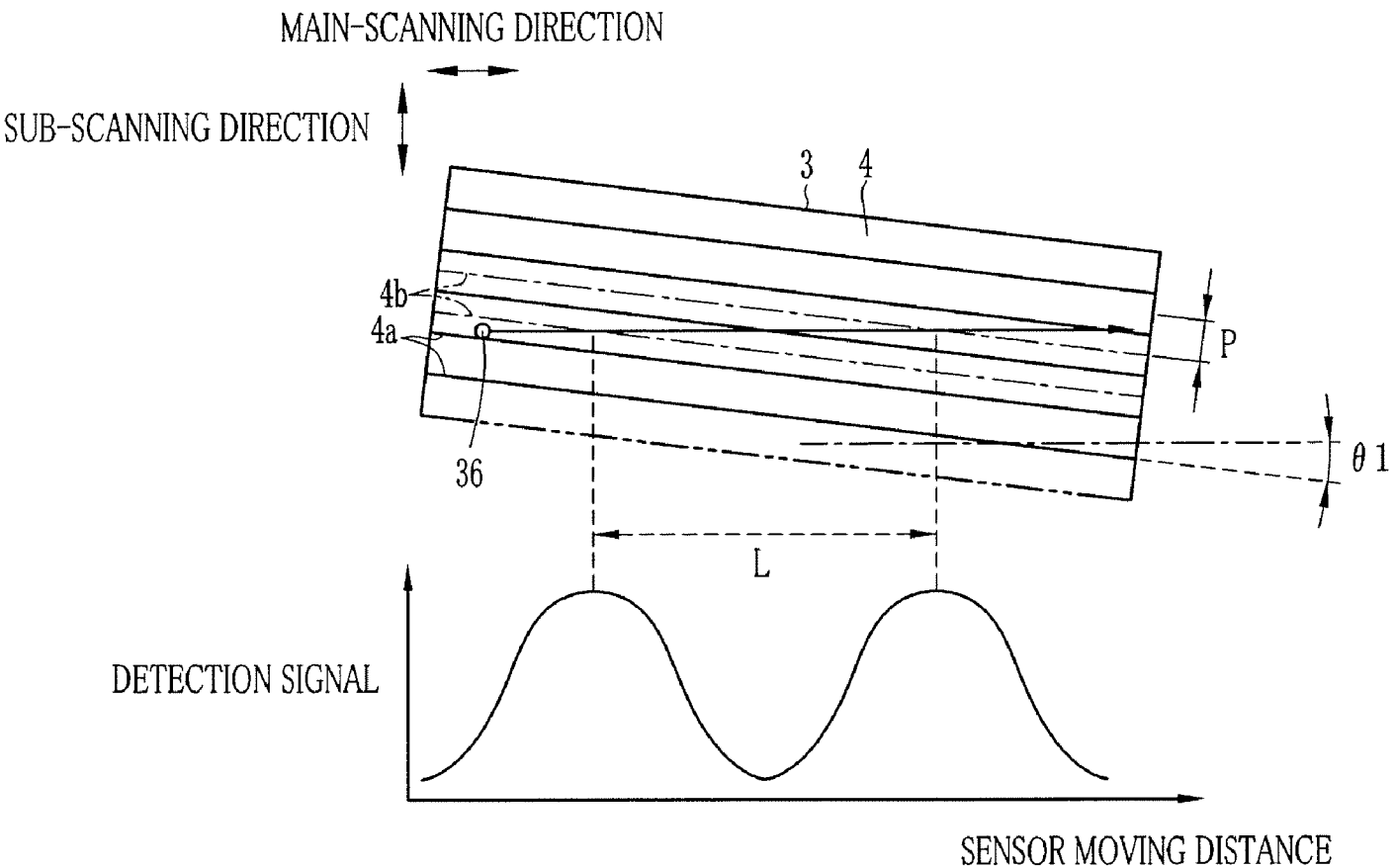
FIG. 9 is an explanatory drawing which illustrates a relation between a detection signal and a position of the sensor, which relatively moves in a sub-scanning direction, relative to the lenticular sheet.

A third embodiment is illustrated in FIG. 9. In this embodiment, the sensor unit 36 is moved in the main-scanning direction (the direction parallel to the longitudinal direction of the lens 4) relative to the lenticular sheet 3 to obtain the detection signal, and then, the oblique transportation angle 91 of the lenticular sheet 3 is calculated from the obtained detection signal. After that, the clamper 18 is rotated to cancel the oblique transportation angle θ1. In this case, the oblique transportation angle θ1 can be expressed as a following Formula 3:

$$\theta 1 = \mathrm{Tan}^{-1}(P/L) \qquad \text{[Formula 3]}$$

wherein L is a transportation length of the sensor unit 36 in the main-scanning direction while one cycle of the detection signal (for example, peak to peak) is detected, and P is the lens pitch of the lenticular sheet 3.

In order to move the sensor unit 36 in the main-scanning direction relative to the lenticular sheet 3, a sensor moving mechanism for moving the sensor unit 36 in the main-scanning direction may be provided, such that the sensor unit 36 is moved while the transportation of the lenticular sheet 3 is halted. In case that the sensor unit 36 is moved in the main-scanning direction relative to the lenticular sheet 3, as in the case of moving the sensor unit 36 in the sub-scanning direction, the clamper 18 rotates the lenticular sheet 3 by predetermined degrees, for example, degrees corresponding to the oblique transportation angle θ1 in one direction, and then the calculation of the oblique transportation angle is performed again. If a larger oblique transportation angle is obtained, the lenticular sheet 3 may be rotated by the degrees corresponding to the oblique transportation angle θ1 in the opposite direction from the initial state.

When the sensor unit 36 is moved in the main-scanning direction relative to the lenticular lens 4, the sensor unit 36 may detect only less than two of the vertexes 4*b* or the boundaries 4*a* in some cases. In this case, based on a gradient of the detection signal from the sensor unit 36, a transportation length of the lens 4 in the arrangement direction relative to a transportation length (hereinafter called as the scanning distance) of the sensor unit 36 in the main-scanning direction is estimated. The oblique transportation angle θ1 can be calculated from the estimated transportation length and scanning distance. The relationship between the gradient of the detection signal and the transportation length in the arrangement direction is determined by a profile of the lens 4. Therefore, for example, a data table which provides the relationship between the gradient of the detection signal and the transportation length in the arrangement direction may be prepared, such that the gradient of the detection signal from sensor unit 36 is converted into the estimated value of the transportation length in the arrangement direction by referring to the data table.

Note that, the clamper 18 may be rotated to rotate the lenticular sheet 3 by certain angles such that the detection is performed again, for the purpose of calculating the oblique transportation angle θ1. Further, minute rotation of the clamper 18 and the measurement scanning of the sensor unit 36 may be performed alternately to find a rotational position of the clamper 18 where a change in a level of the detection signal obtained in the measurement scanning is stopped.

[Fourth Embodiment]

In a fourth embodiment, a reference value obtained by a sensor unit, which detects a test image recorded with use of the thermal head, is used so as to adjust the longitudinal direction of the lens to the main-scanning direction of the thermal head with high precision. Note that, since this embodiment is the same as the first embodiment except a part which is described below, the common components have the same reference number and detailed explanations for the common components are omitted.

Figure 10:
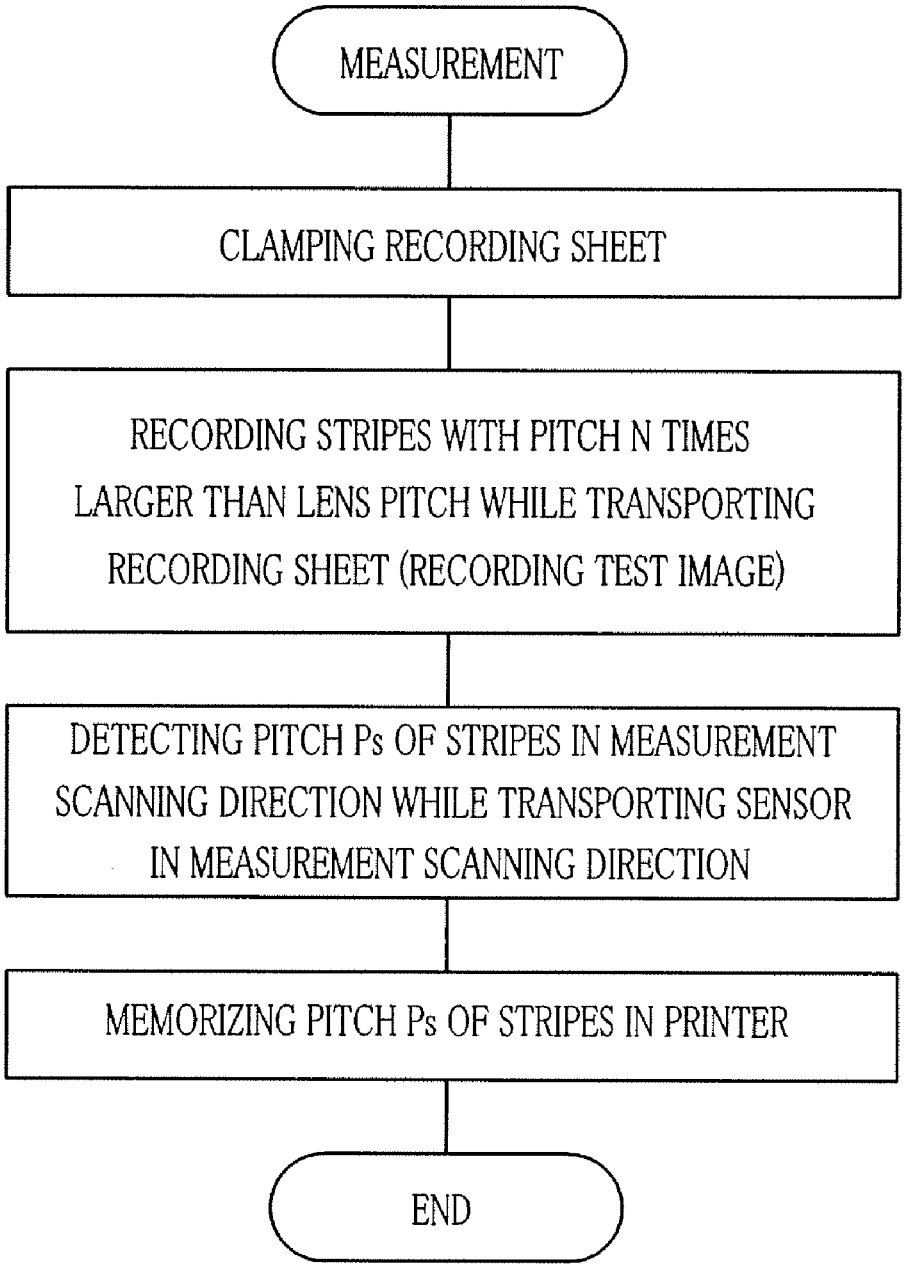
FIG. 10 is a flowchart which illustrates a procedure for calculating a reference value and storing the reference value in the printer.

In this embodiment, as illustrated in FIG. 10, a pitch Ps as the reference value is measured, for example, when the printer 2 is manufactured. For the purpose of measuring the pitch Ps, at first, the clamper 18 clamps a transparent recording sheet 71 (see FIG. 11). Then, the transport mechanism 20 moves the clamper 18 downstream to transport the recording sheet 71. During the transportation of the recording sheet 71, a test image is recorded on the recording sheet 71 with use of the thermal head 22.

Figure 11:
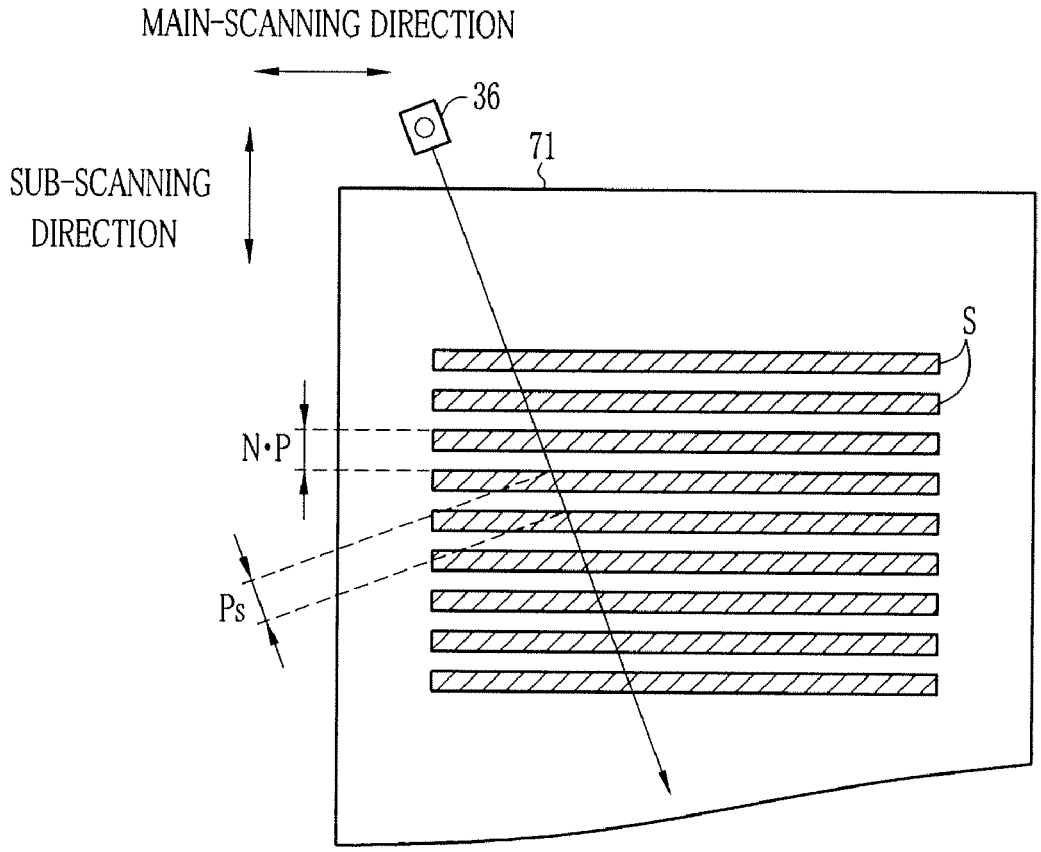
FIG. 11 is an explanatory drawing which illustrates a relation between a measurement scanning direction of the sensor and a test image recorded by the printer.

The test image has a plurality of stripes S elongated in the main-scanning direction as illustrated in FIG. 11. These stripes S are arranged with a pitch, which is N times larger than the lens pitch P (=N·P), from each other in the sub-scanning direction, and are recorded by the thermal head 22 driven in synchronization with the transportation of the recording sheet 71. Each stripe S follows the main-scanning direction in which lines recorded by the thermal head 22 actually extend.

The stripe S may be recorded in any color, for example, yellow, magenta, cyan, or mixture of them, with use of the ink film 26. However, in this embodiment, the stripe S is recorded in white with use of the back film 27, to reduce costs for recording the test image.

Relative to the area of the recording sheet 71 in which the test image is recorded, the sensor unit 36 is relatively moved in the measurement scanning direction, for the measurement scanning. Then, the pitch Ps of the stripes Sin the measurement scanning direction is calculated from the obtained detection signal and the transportation length of the sensor unit 36 in the measurement scanning direction. The calculated pitch Ps is stored in a nonvolatile memory (not illustrated) of the printer 2.

Note that, in case that the sensor unit 36 is positioned upstream from the thermal head 22, the recording sheet 71 may be transported upstream once without rotation of the clamper 18 after recording of the test image, and then the measurement scanning may be performed while the recording sheet 71 is transported downstream again.

Figure 12:
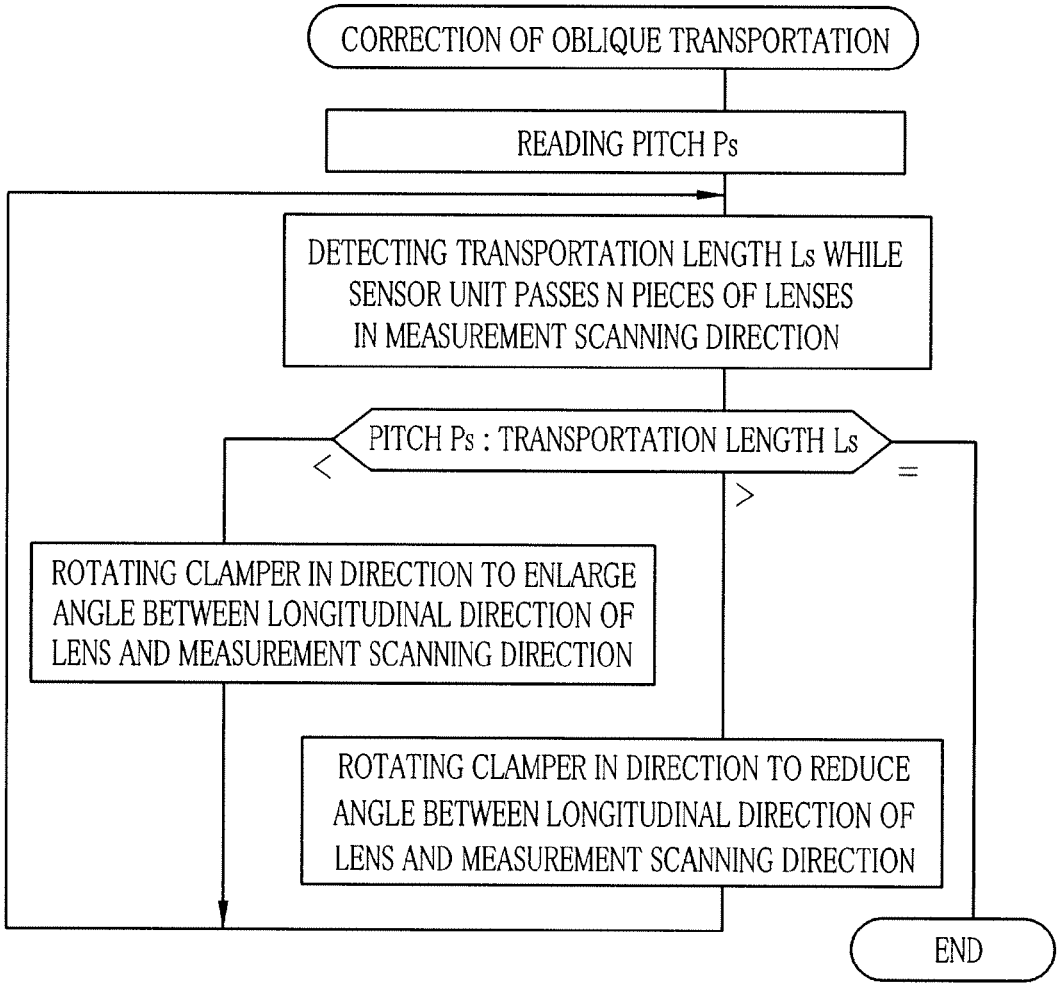
FIG. 12 is a flowchart which illustrates a procedure for correcting a rotational angle of the clamper with use of the reference value.

In order to correct the oblique transportation of the lenticular sheet 3 in image recording, as illustrated in FIG. 12, the measurement scanning is performed while the lenticular sheet clamped by the clamper 18 is transported. Then, the transportation length Ls of the sensor unit 36 (the sensor unit passes N pieces of lenses) in the measurement scanning direction is calculated based on the obtained detection signal. The calculated result is compared with the pitch Ps.

The transportation length Ls calculated as described above is equal to the pitch Ps if the longitudinal direction of the lens 4 coincides with the main-scanning direction in which the heater element array 22*a* extends. In addition, based on whether the transportation length Ls is longer or shorter than the pitch Ps, the direction of displacement of the longitudinal direction of the lens 4 relative to the main-scanning direction can be judged.

If the transportation length Ls is longer than the pitch Ps, the clamper 18 is rotated by a minute angle in a direction where an angle between the longitudinal direction of the lens 4 and the measurement scanning direction becomes larger. If the transportation length Ls is shorter than the pitch Ps, the clamper 18 is rotated by a minute angle in a direction where the angle between the longitudinal direction of the lens 4 and the measurement scanning direction becomes smaller. In any cases, after the rotation of the clamper 18, the transportation length Ls of the sensor unit 36 (the sensor unit passes N pieces of lenses) is measured while the lenticular sheet 3 is transported, and the measured result is compared with the pitch Ps.

The detection and rotation described above are repeated until the transportation length Ls becomes equal to the pitch Ps. Accordingly, the oblique transportation of the lenticular sheet 3 is corrected so that the longitudinal direction of the lens 4 coincides with the main-scanning direction.

According to this embodiment, the oblique transportation of the lenticular sheet 3 can be accurately corrected, even if there is inconsistency between the main-scanning direction of the thermal head 22 and the measurement scanning direction of the sensor unit 36. This contributes to easy manufacture and maintenance of the thermal head 22, the sensor unit 36, and the like, because high accuracy is not required to install these components. In addition, the manufacturing cost can be reduced since there is no need to manufacture each component with high accuracy.

In the above, the sensor unit 36 moves in the measurement scanning direction which has the predetermined measurement scanning angle θ0 from the main-scanning direction. However, the above description can be applied also in the case of moving the sensor unit 36 in the sub-scanning direction. In this case, the direction of displacement of the longitudinal direction of the lens 4 relative to the main-scanning direction cannot be found based on whether the transportation length Ls is longer or shorter than the pitch Ps. In consideration of this problem, the lenticular sheet 3 is rotated by a minute angle with the clamper 18 to measure again the transportation length Ls. Then, the direction in which the clamper 18 should be rotated to correct the oblique transportation is judged based on the rotation direction of the clamper 18, variation amount of the transportation length Ls, and whether the transportation length is increased or decreased.

Figure 13:
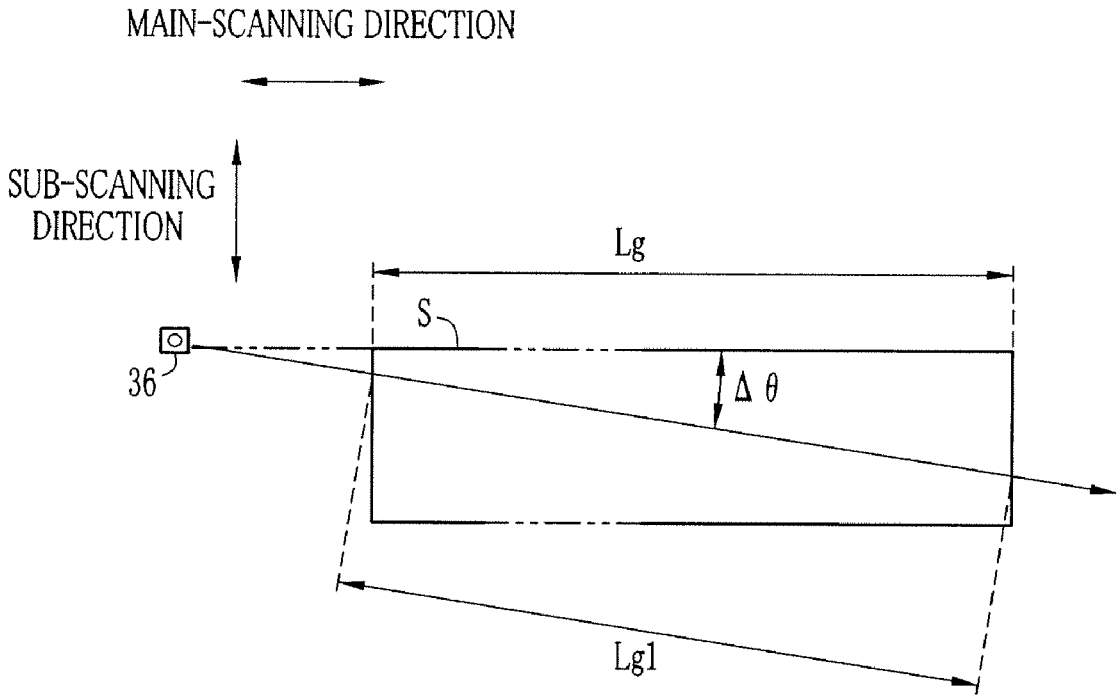
FIG. 13 is an explanatory drawing illustrating an embodiment in which a correction angle is calculated as the reference value for moving the sensor in the main-scanning direction.

In the case of moving the sensor unit 36 relative to the main-scanning direction, as illustrated in FIG. 13, a correction angle Δθ of the moving direction of the sensor unit 36 relative to the actual main-scanning direction (the direction in which the heater element array 22*a* extends) may be calculated as the reference value, so as to correct a rotational position of the clamper 18 with use of the reference value. In this case, the correction angle Δθ is calculated from a stripe length Lg which is actually printed along the main-scanning direction and a detection length Lg1 which is the actual transportation length of the sensor unit 36 measured when the sensor unit 36 is moved. The calculated correction angle Δθ is stored in the memory in the printer 2. After the oblique transportation of the lenticular sheet 3 is corrected with use of the method of the third embodiment, the rotational position of the clamper 18 is corrected by the correction angle Δθ. Accordingly, the longitudinal direction of the lens 4 becomes parallel to the actual main-scanning direction.

In the above embodiments, the longitudinal direction of the lens 4 is parallel to the main-scanning direction during the transportation of the lenticular sheet 3. However, the longitudinal direction of the lens 4 may be parallel to the sub-scanning direction during the transportation of the lenticular sheet 3. Further, in the above embodiments, the present invention is applied to the line printer. However, the present invention can be applied to other types of printers, such as a serial printer. In addition, the present invention can be used for recording so-called a changing image in which movement of a viewer or a print causes the image to flip from one image to another image, in addition to recording the parallax images for making the stereo image. The present invention can be applied to a thermofusible type thermal printer, an ink-jet printer, and the like, in addition to the sublimation type thermal printer.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer comprising:

a clamper which clamps an edge of a lenticular sheet having a plurality of lenticular lenses;

a sheet transporter which moves said clamper in a sub-scanning direction to transport said lenticular sheet;

a recorder which records lines extended along a main-scanning direction sequentially on a rear side of said lenticular sheet in synchronization with transportation of said lenticular sheet by heating a rear side of an ink film putted on the rear side of said lenticular sheet with use of a thermal head such that ink is sublimated from said ink film and adhered on the rear side of said lenticular sheet, said lines constituting a linear image;

a rotation mechanism which rotates said clamper on a transportation surface of said lenticular sheet; and a rotation controller which optically detects an inclination of said lenticular lens in a longitudinal direction from said main-scanning direction or said sub-scanning direction while said lenticular lens is on said lenticular sheet clamped by said clamper, and controls said rotation mechanism based on the detection result such that the longitudinal direction of said lenticular lens becomes parallel to said main-scanning direction or said sub-scanning direction.

2. A printer claimed in claim 1, further comprising:

a sensor including a light projector for projecting inspection light toward said lenticular sheet and a light receiver for receiving said inspection light having passed through said lenticular sheet and outputting a detection signal corresponding to a received amount of said inspection light; and a sensor transporter for transporting said sensor relative to said lenticular sheet, wherein said rotation controller calculates an inclination angle of said lenticular lens in the longitudinal direction from said main-scanning direction or said sub-scanning direction based on said detection signal obtained while said sensor moves relative to said lenticular sheet, and controls said rotation mechanism such that said inclination angle is canceled through rotation of said clamper.

3. A printer claimed in claim 2, wherein said sensor transporter transports said sensor relative to said lenticular sheet in a direction which has a predetermined measurement scanning angle from said main-scanning direction.

4. A printer claimed in claim 2, wherein said measurement scanning angle is no more than 45°.

5. A printer claimed in claim 2, wherein said sensor transporter transports said sensor relative to said lenticular sheet in said sub-scanning direction.

6. A printer claimed in claim 2, wherein said sensor transporter transports said sensor in said main-scanning direction while transportation of said lenticular sheet is halted.

7. A printer claimed in one of claims 2 to 6, wherein said sensor transporter transports said sensor between said thermal head and said clamper.

8. A printer claimed in claim 7, wherein said recorder forms a transparent image receptor layer, on which said ink is to be adhered, on the rear side of said lenticular sheet, before recording an image including a plurality of said linear images with use of said ink film, wherein said sheet transporter transports said lenticular sheet from upstream side to downstream side with respect to said thermal head to form said image receptor layer, and then transports said lenticular sheet again from upstream side to downstream side with respect to said thermal head to record said image with use of said ink film, and wherein said sensor transporter transports said sensor relative to said lenticular sheet while said lenticular sheet is transported to form said image receptor layer.

9. A printer claimed in claim 1, further comprising:

a sensor including a light projector for projecting inspection light toward said lenticular sheet and a light receiver for receiving said inspection light having passed through said lenticular sheet and outputting a detection signal corresponding to a received amount of said inspection light;

a sensor transporter for transporting said sensor relative to said lenticular sheet; and a memory for memorizing a reference value obtained from a detection signal which is made while said sensor is transported by said sensor transporter relative to a test image, said test image having a plurality of stripes extended in said main-scanning direction and arranged in said sub-scanning direction at a predetermined pitch and being recorded on a transparent recording sheet by said thermal head while said transparent recording sheet clamped by said clamper is transported by said sheet transporter, wherein said rotation controller controls rotation of said clamper based on said reference value memorized in said memory and said detection signal obtained while said sensor is transported relative to said lenticular sheet.

10. A printing method for recording lines extended along a main-scanning direction and arranged along a sub-scanning direction sequentially on a rear side of a lenticular sheet in synchronization with transportation of said lenticular sheet in said sub-scanning direction by heating a rear side of an ink film putted on the rear side of said lenticular sheet with use of a thermal head extended along said main-scanning direction heat such that ink is sublimated from said ink film and adhered on the rear side of said lenticular sheet, said lines constituting a linear image, said printing method comprising steps of:

optically detecting an inclination of a lenticular lens in a longitudinal direction from said main-scanning direction or said sub-scanning direction, while said lenticular lens is on said lenticular sheet; and rotating a clamper, which clamps an edge of said lenticular sheet and moves in said sub-scanning direction to transport said lenticular sheet, based on the detection result, such that the longitudinal direction of said lenticular lens becomes parallel to said main-scanning direction or said sub-scanning direction.

11. A printing method claimed in claim 10, wherein said detecting step including:

obtaining a detection signal by transporting a sensor for projecting inspection light toward said lenticular sheet and receiving said inspection light having passed through said lenticular sheet relative to said lenticular sheet; and calculating an inclination angle of said lenticular lens in the longitudinal direction from said main-scanning direction or said sub-scanning direction based on said detection signal.

12. A printing method claimed in claim 11, wherein said sensor is transported relative to said lenticular sheet in a direction which has a predetermined measurement scanning angle from said main-scanning direction.

13. A printing method claimed in claim 12, wherein said measurement scanning angle is no more than 45°.

14. A printing method claimed in claim 11, wherein said sensor is transported relative to said lenticular sheet in said sub-scanning direction.

15. A printing method claimed in claim 11, wherein said sensor is transported in said main-scanning direction while transportation of said lenticular sheet is halted.

16. A printing method claimed in one of claims 11 to 15, wherein said sensor is transported between said thermal head and said clamper.

17. A printing method claimed in claim 16, wherein said detection signal is obtained, while said sensor is moved relative to said lenticular sheet which is transported from upstream side to downstream side with respect to said thermal head such that a transparent image receptor layer, on which said ink is to be adhered, is formed on the rear side of said lenticular sheet, before recording an image including a plurality of said linear images with use of said ink film.

18. A printing method claimed in claim 10, wherein said detecting step including:

obtaining a reference value from a detection signal which is made while said sensor is transported relative to a test image, said test image having a plurality of stripes extended in said main-scanning direction and arranged in said sub-scanning direction at a predetermined pitch and being recorded on a transparent recording sheet by said thermal head while said transparent recording sheet clamped by said clamper is transported, said sensor projecting inspection light toward said recording sheet, receiving said inspection light having passed through said recording sheet, and outputting said detection signal corresponding to a received amount of said inspection light; and controlling rotation of said clamper based on said reference value and said detection signal obtained while said sensor is moved relative to said lenticular sheet.

* * * * *